US005931316A

United States Patent [19]

Carpinelli

[11] Patent Number: 5,931,316

[45] Date of Patent: Aug. 3, 1999

[54] INFORMATION RECEPTACLE

[76] Inventor: Michael J Carpinelli, 506 Mace St., Greensburg, Pa. 15601

[21] Appl. No.: 08/888,787

[22] Filed: Jul. 7, 1997

[51] Int. Cl.[6] ..... A47F 5/00

[52] U.S. Cl. ..... 211/50; 211/119.003; 211/86.01; 108/26

[58] Field of Search ..... 211/119.003, 50, 211/86.01, 94.01, 85.29, DIG. 1, 88.01; 108/26

[56] References Cited

U.S. PATENT DOCUMENTS

| | | | |
|---|---|---|---|
| 2,140,611 | 12/1938 | Smith et al. | 108/26 |
| 2,888,146 | 5/1959 | Teas | 211/86.01 |
| 3,510,008 | 5/1970 | Mason | 211/50 X |
| 3,741,131 | 6/1973 | Leadbetter | 211/86.01 X |
| 4,241,668 | 12/1980 | Carroll | 108/26 |
| 4,488,653 | 12/1984 | Belokin | 211/184 |
| 4,552,272 | 11/1985 | Field | 211/88.01 |
| 5,036,990 | 8/1991 | Verchere | 211/85.29 |
| 5,094,349 | 3/1992 | DeVito | 211/88.01 |
| 5,497,877 | 3/1996 | Ali et al. | 211/50 X |

*Primary Examiner*—Robert W. Gibson, Jr.
*Attorney, Agent, or Firm*—H. Keith Hauger, Esq.

[57] ABSTRACT

A receptacle for receiving, holding and displaying relatively flat articles, and in particular, pamphlets and brochures. The information receptacle consists of a body which actually holds the pamphlets and brochures and adjustable front and rear mounting brackets which may be interchanged with each other to mount to most shelving whether it is solid or metal shelving with lips underneath. A preferred embodiment of the front mounting bracket is J-shaped and the rear mounting means consists of two dog-legged brackets with upper lips to overlap the top of a shelf. A second embodiment of a mounting bracket is U-shaped and may be used at the front or rear or both ends of the information receptacle.

11 Claims, 5 Drawing Sheets

INFORMATION RECEPTACLE

BACKGROUND OF THE INVENTION

1. Field of the Invention

The present invention relates to an information receptacle for receiving, holding and displaying relatively flat articles. More particularly, the invention relates to a shelf attachment which may be secured to almost any type of shelf for encasing, viewing and accessing any type of flat articles, and in particular, pamphlets and brochures. A forward attachment bracket fits neatly over the edge of a shelf. Two rearward brackets slide in and out of a channel and have a lip which fits up over the top surface of a shelf. In the event of a tight tolerance between the back of the shelf and a wall located to the rear of said shelf, the present invention provides for an alternate U-shaped clip secured to a horizontally slidable plate which fits into a lip at an edge underneath any metal or similarly shaped shelf.

Many business offices, professional offices, pharmacies and retail stores utilize standard and existing type shelving for storage purposes. Oftentimes, there is a need to display certain pamphlets, brochures and informational documents to make them readily accessible to the public. The present invention solves this problem by providing an information and distribution shelf which may be readily attached to various types of existing shelving without modification thereto.

2. Description of the Prior Art

There are several receptacles known in the industry which are designed to be attached to shelves. U.S. Pat. No. 3,741,131 to Leadbetter in 1973 is a detachable, adjustable shelf extension used for temporary storage of merchandise while stocking or merchandising items on its permanent shelf. This shelf extension is attached to a permanent shelf by use of a combination of adjustable wing nuts, a removable channel and a cantilever arm. The primary use of this device is in the retail sales industry, and in particular, retail grocery stores where it is frequently necessary to replace shelved merchandise. U.S. Pat. No. 2,811,260 to Goldstein in 1957 is illustrative of a card holding device in a stockroom or other area where articles are grouped by types or kinds on shelves. This receptacle holds cards pertaining to the articles of certain groups that are being inventoried, billed or otherwise grouped. Another attempt at a merchandise display and feeding device is illustrated in U.S. Pat. No. 3,007,580 to Dickson in 1961. Dickson's patent describes a device which is marketed to the retail sales industry, and in particular, retail grocery stores. It consists of a basket constructed from wires or rods which are welded or soldered together at various points throughout its container-like construction.

Inspite of the foregoing disclosures, a need remains for an improved device for receiving, holding and displaying relatively flat articles under a shelf.

SUMMARY OF THE INVENTION

It is, therefore, an object of the subject invention to provide an information receptacle for receiving, holding and displaying relatively flat articles which is readily fastened to a shelf.

It is the further object of this invention to provide an information receptacle which hangs below an existing permanent shelf and eliminates the need to remove any articles held by said shelf.

It is the further object of this invention to provide an information receptacle designed with interchangeable mounting brackets making said information shelf adaptable to various different shelving styles, designs and sizes.

It is the further object of this invention to provide an information receptacle which is translucent enabling an easy viewing of any articles contained in same and of any written shelving labels which adhere to the permanent shelf to which the receptacle attaches.

It is the further object of this invention to provide an information receptacle which is firmly secured to a permanent shelf by use of a magnet which is located between a J-shaped front bracket plate and a top surface of the shelf and causes the information receptacle to be secure and even more so when the shelf is made of a metallic material.

It is the further object of this invention to provide an information receptacle which is particularly valuable for use in a retail pharmacy business which distributes informational literature and pamphlets concerning pharmaceuticals and other health-related information.

And yet, a further object of this invention is to provide an information receptacle for receiving, holding and displaying relatively flat articles, which receptacle is fastened to a shelf, comprising a holding means adjustably attached underneath said shelf for encasing, viewing and accessing said articles; a forward attachment means for adjustably securing said receptacle to a front edge of said shelf; a rearward attachment means for adjustably securing said receptacle to a rear edge of said shelf.

BRIEF DESCRIPTION OF THE DRAWINGS

These objects, as well as other novel features and advantages of the subject invention, will be better appreciated and understood when the following description is read along with the accompanying drawings, of which.

DETAILED DESCRIPTION OF PREFERRED EMBODIMENTS OF THE SUBJECT INVENTION

Figure 1:
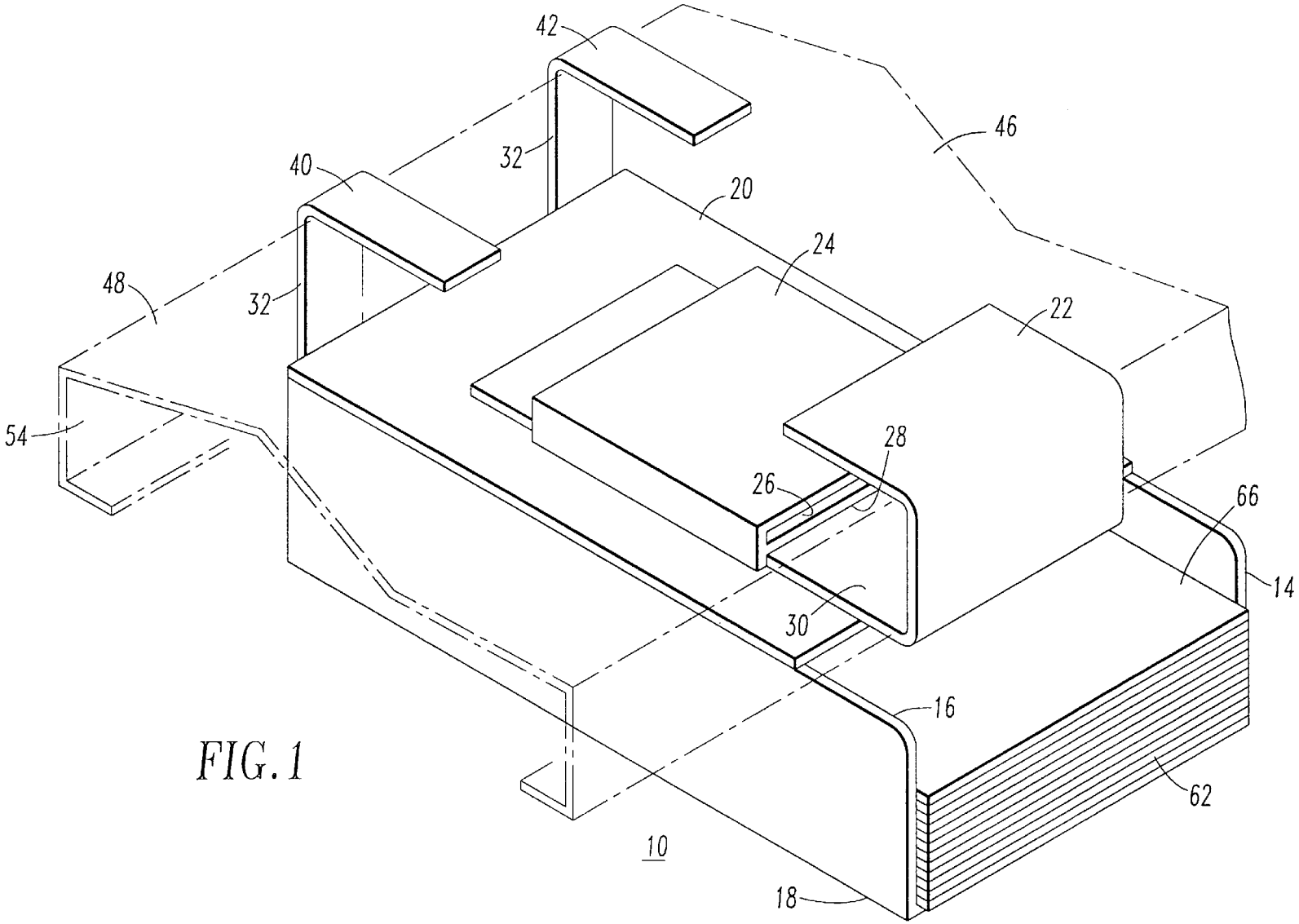
FIG. 1 is a perspective view of an information receptacle attached to a shelf.

FIG. 1 illustrates a perspective view of an information receptacle 10 shown as attached to a shelf 46.

Figure 2:
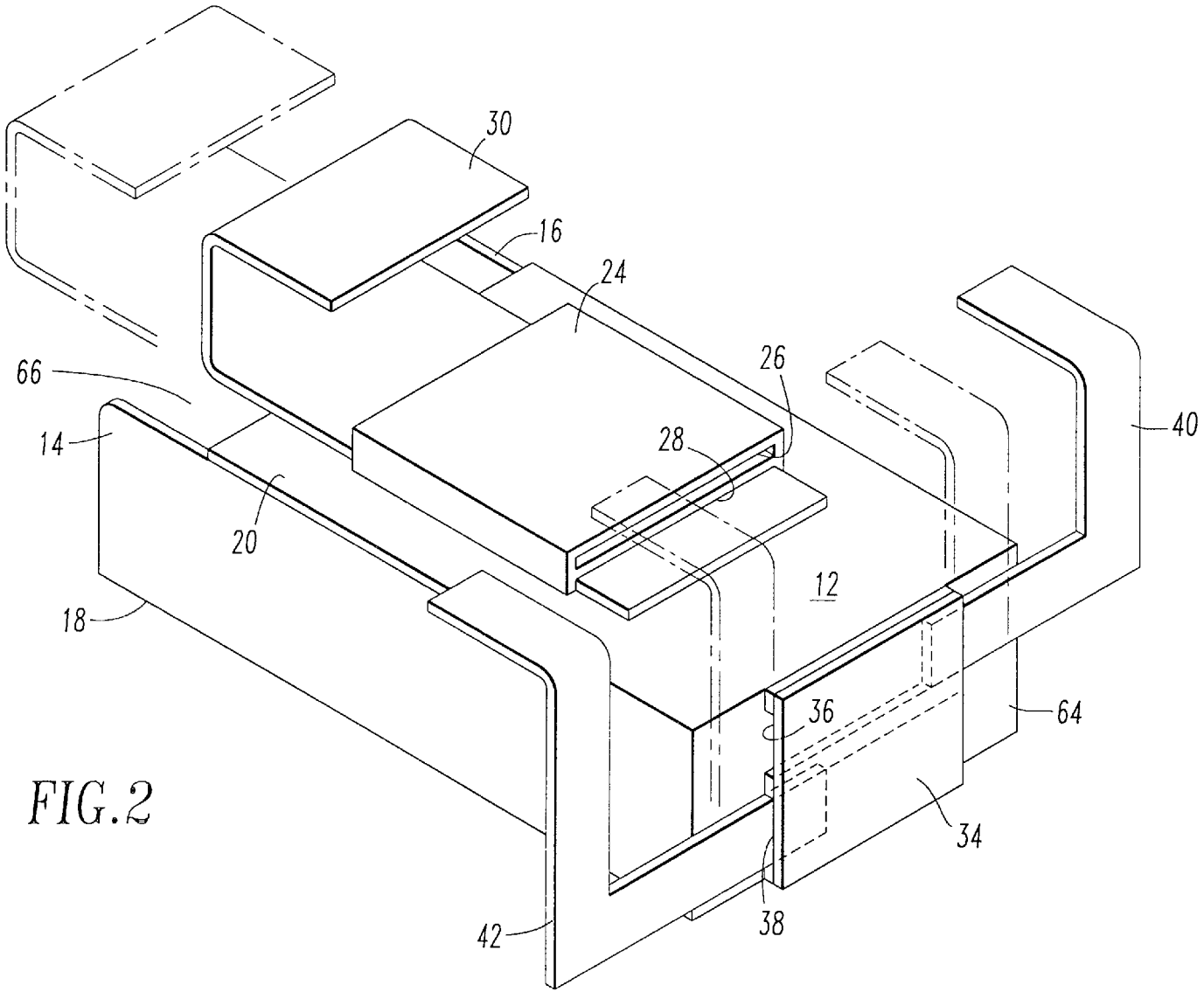
FIG. 2 is a detailed perspective view of an information receptacle showing a first embodiment of a rearward attachment means.
Figure 3:
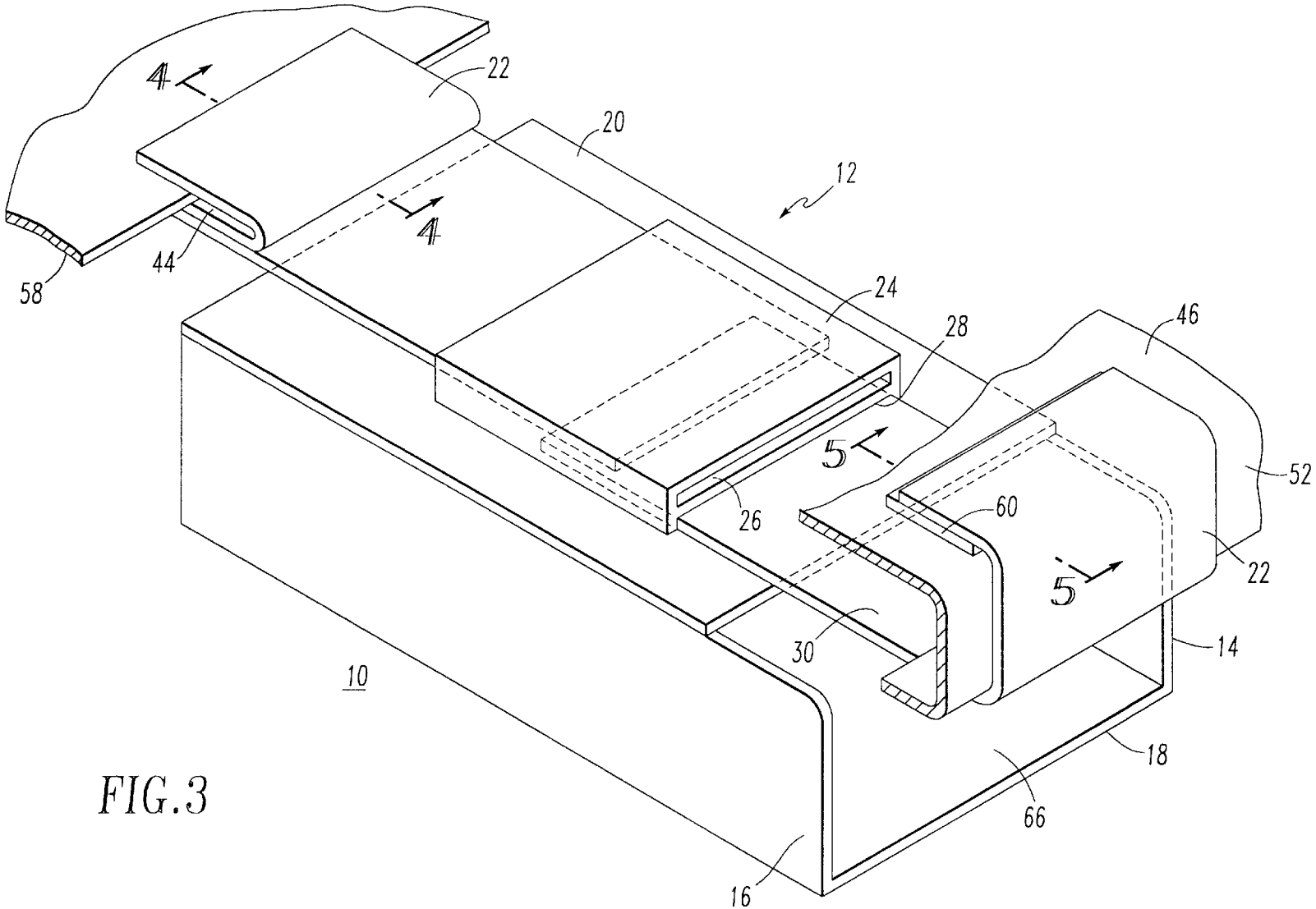
FIG. 3 is a detailed perspective view of an information receptacle showing a second embodiment of a rearward attachment means.

FIGS. 2 and 3 further illustrate information receptacle 10 with its main components body 12 for receiving, holding and displaying relatively flat articles 62 by attachment to shelf 46 through front attachment means 22 and rear attachment means 32.

Body 12 consists of first vertical panel 14, a second vertical panel 16, a lower horizontal panel 18 which interconnects first vertical panel 14 and second vertical panel 16 at lower edges thereof and upper horizontal panel 20 which interconnects first vertical panel 14 and second vertical panel 16 at an upper edge thereof. Body 12 further consists of a rearward vertical end panel 64 which interconnects to rearward edges of first vertical panel 14, second vertical panel 16, lower horizontal panel 18 and upper horizontal panel 20 leaving a front open end 66 of body 12 for inserting and accessing said flat articles 62.

FIG. 2 shows more detail of a rearward view of body 12 and illustrates in detail a preferred embodiment of rear attachment means 32 which consists of a pair of opposing mounting brackets labeled as left rear mounting bracket 40 and right rear mounting bracket 42. Left rear mounting bracket 40 and right rear mounting bracket 42 slide into or out of second mounting channel 34. Left rear mounting bracket 40 and right rear mounting bracket 42 are shaped to protrude over upper surface 48 of shelf 46. Left rear mounting bracket 40 consists of left horizontal leg 68 for sliding into or out of upper slot 36 of second mounting channel 34 and right rear mounting bracket 42 consists of right horizontal leg 70 for sliding in and out of lower slot 38 of second mounting channel 34. Left rear mounting bracket 40 further consists of left vertical leg 71 which connects to left upper lip 73 which is angled 90 degrees from an upper end of left vertical leg 71 towards front open end 66. Likewise, right rear mounting bracket 42 further consists of right vertical leg 72 which connects to right upper lip 74 which is angled 90 degrees from an upper end of right vertical leg 72 towards front open end 66. Left vertical leg 71 and right vertical leg 72 both come in contact with rear edge 54 of shelf 46 when body 12 is secured to shelf 46.

While information receptacle 10 is generally held in place as a unit on shelf 46 by forces of gravity, a magnet 60 glued to an underside 76 of J-shaped front mounting bracket 30 causes J-shaped front mounting bracket 30 to adhere more securely to especially metal shelving and prevents information receptacle 10 from moving.

FIG. 3 further illustrates front attachment means 22 which consists of j-shaped front mounting bracket 30 which slides into or out of a first mounting channel 24 and engages shelf 46 at a front edge 52 of shelf 46. First mounting channel 24 further consists of upper slot 26 and lower slot 28. Lower slot 28 is generally used to allow j-shaped front mounting bracket 30 to slide in and out thereof, whereas upper slot 26 is generally used to allow reversible U-shaped mounting bracket 44 to slide in and out thereof. These positions are preferred for optimizing information receptacle 10 in a level position. U-shaped mounting bracket 44 is reversible and may be used as either a front attachment means 22 or a rear attachment means 32 or both.

Figure 4:
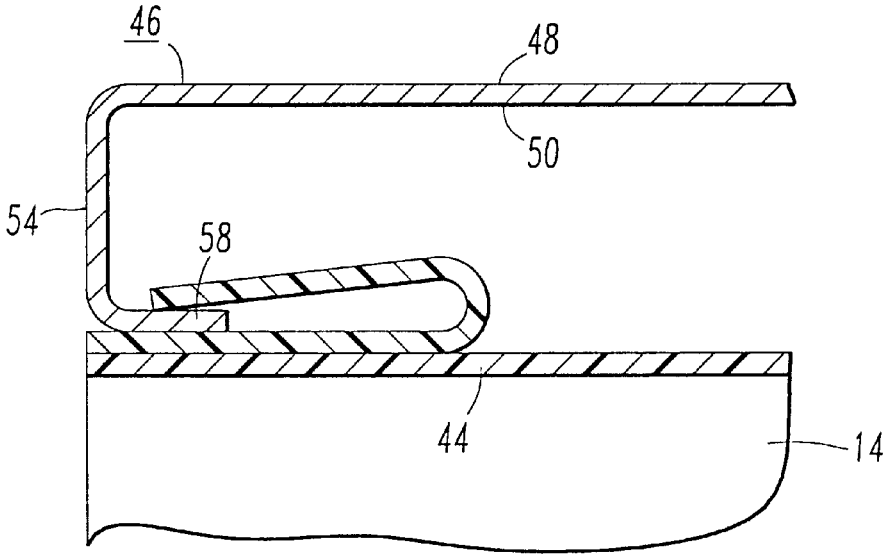
FIG. 4 is a side elevational view of an information receptacle showing a second embodiment of the rearward attachment means.
Figure 5:
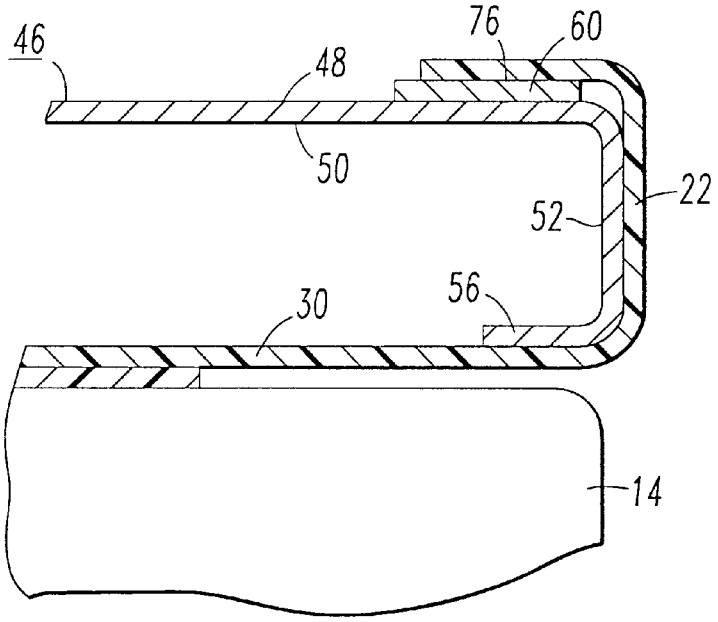
FIG. 5 is a side elevational view of an information receptacle showing a forward attachment means securing an information receptacle to a shelf.
Figure 6:
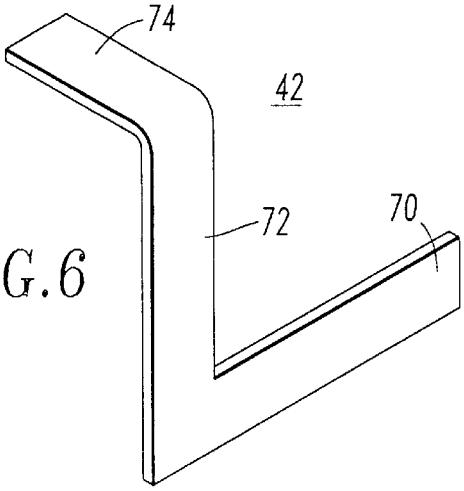
FIG. 6 is a perspective view of a left rear mounting bracket.
Figure 7:
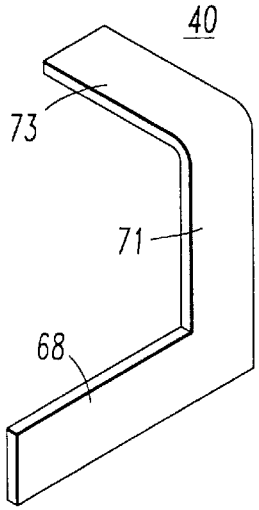
FIG. 7 is a perspective view of a right rear mounting bracket.
Figure 8:
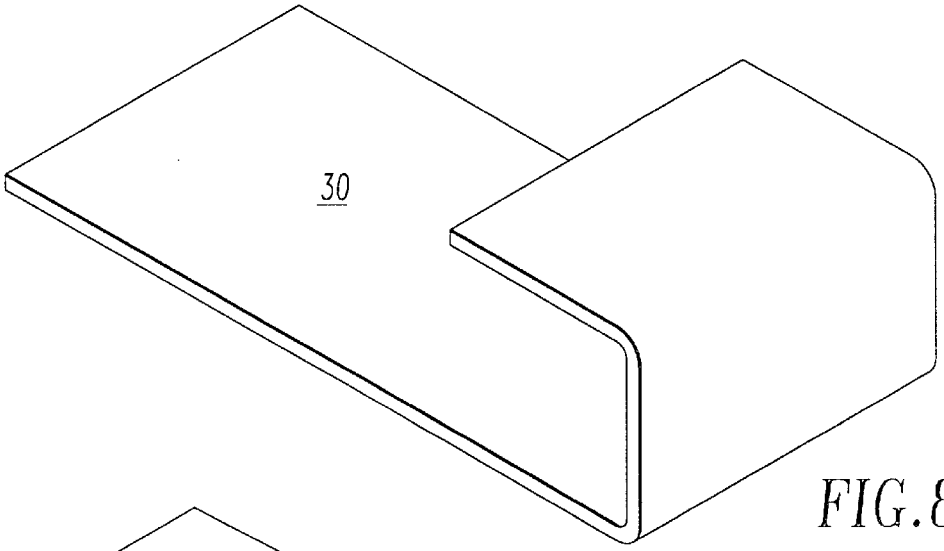
FIG. 8 is a perspective view of a J-shaped plate being an essential element of a forward attachment means.
Figure 9:
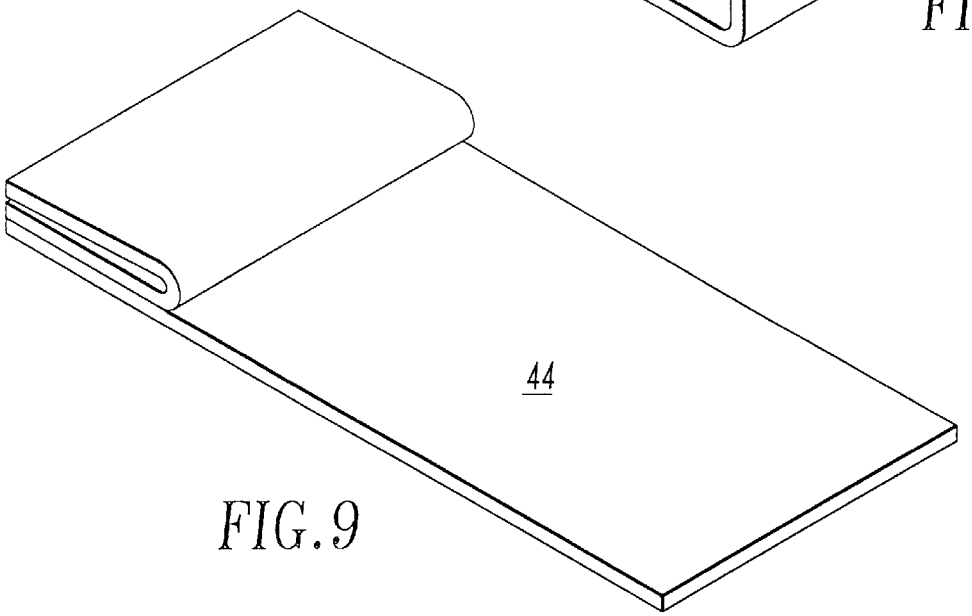
FIG. 9 is a perspective view of a U-shaped plate being an essential element of a second embodiment of a rearward attachment means.

A second embodiment of information receptacle 10 is seen in FIG. 3 where reversable unshaped mounting bracket 44 is illustrated as attaching to a rear under lip 58 of shelf 46 in most instances when shelf 46 is constructed of a metallic material or otherwise so as to create a rear under lip 58 as shown in FIG. 4. Likewise, this interchangeable reversable u-shaped mounting bracket 44 is reversible and may be used on a front under lip 56 seen in FIG. 5 instead of J-shaped front mounting bracket 30 in the instance when the store or pharmacy may have a cover (not shown) made of plastic or other material at front edge 52.

Information receptacle 10 is preferably made with a translucent PETG rigid plastic material enabling an easy viewing of flat articles 62 and any written material including shelving labels which may adhere to shelf 46.

In accordance with the patent statutes, I have explained the principle and operation of my invention, and have illustrated and described what I consider to represent the best embodiment thereof.

I claim:

1. An information receptacle for receiving, holding and displaying relatively flat articles, which receptacle is fastened to a shelf, comprising:

a holding means adjustably attached underneath said shelf for encasing, viewing and accessing said articles;

a forward attachment means for adjustably securing said receptacle to a front edge of said shelf wherein said forward attachment means consists of a J-shaped plate having an elongated horizontal section for sliding into or out of a first channel mounted to an upper outside surface of said holding means and a hook-like end conforming to the shape of a front edge of said shelf, wherein said rearward attachment means consists of a pair of slidably opposing mounting brackets for sliding into or out of a second channel mounted to an outside surface of said rearward end panel of said holding means, wherein each of said brackets consist of a horizontal leg for sliding into or out of said second channel, a vertical leg integral to said horizontal leg at an end of said horizontal leg forming a dog-leg configuration and a third leg functioning as a lip at an upper end of said vertical leg angled 90 degrees from said upper end extending horizontally towards said front open end of said holding means;

a rearward attachment means for adjustable securing said receptacle to a rear edge of said shelf.

2. An information receptacle for receiving, holding and displaying relatively flat articles which receptacle is fastened to a shelf, comprising:

a holding means adjustably attached underneath said shelf for encasing, viewing and accessing said articles consisting of opposing sidewalls, a lower horizontal panel opposing an upper horizontal panel, whereby said lower horizontal panel interconnects with said opposing sidewalls at a lower edge of said sidewalls and said upper horizontal panel interconnects with said opposing sidewalls and an upper edge of said sidewalls and further having a rearward vertical end panel causing said holding means to be enclosed except at a front open end defined as a receptacle opening;

a forward attachment means for adjustably securing said receptacle to a front edge of said shelf consisting of a J-shaped plate having an elongated horizontal section for sliding into or out of a first channel mounted to an upper outside surface of said holding means and a hook-like end conforming to the shape of a front edge of said shelf, wherein said rearward attachment means consists of a pair of slidably opposing mounting brackets for sliding into or out of a second channel mounted to an outside surface of said rearward end panel of said holding means, wherein each of said brackets consist of a horizontal leg for sliding into or out of said second channel, a vertical leg integral to said horizontal leg at an end of said horizontal leg forming a dog-leg configuration and a third leg functioning as a lip at an upper end of said vertical leg angled 90 degrees from said upper end extending horizontally towards said front open end of said holding means;

a rearward attachment means for adjustably securing said receptacle to a rear edge of said shelf.

3. An information receptable for receiving, holding and displaying relatively flat articles, which receptacle is fastened to a shelf according to claim 2, wherein said receptacle opening of said holding means is further defined by lessening a length of said upper horizontal panel to be shorter than said opposing sidewalls and said lower horizontal panel permitting easier access to said articles through an enlarged receptacle opening.

4. An information receptacle for receiving, holding and displaying relatively flat articles, which receptacle is fastened to a shelf according to claim 3, wherein said receptacle is constructed of a translucent material enabling a clear view of said articles and written shelving labels adhering to said shelf.

5. An information receptacle for receiving, holding and displaying relatively flat articles, which receptacle is fastened to a shelf according to claim 1, wherein a magnet is attached to and under surface of said hook-like end of said J-shaped plate such that said magnet is positioned horizontally to be in contact with a horizontal upper surface of said shelf preventing said receptacle from lateral movement.

6. An information receptacle for receiving, holding and displaying relatively flat articles, which receptacle is fastened to a shelf, comprising:

a holding means adjustably attached underneath said shelf for encasing, viewing and accessing said articles defined by an elongated parallelepiped being closed on all sides and one end allowing for an open end at a forward end of said holding means;

a forward attachment means for adjustably securing said receptacle to a front edge of said shelf consisting of a J-shaped plate having an elongated horizontal section for sliding into or out of a first channel mounted to an upper outside surface of said holding means and a hook-like end conforming to the shape of a front edge of said shelf;

a rearward attachment means for adjustably securing said receptacle to a rear edge of said shelf consisting of a pair of slidably opposing mounting brackets for sliding into or out of a second channel mounted to an outside surface of a rearward end panel of said holding means, wherein each of said brackets consists of a horizontal leg for sliding into our out of said second channel, a vertical leg connecting to said horizontal leg in a dog leg configuration whereby a third extends from a top edge of said vertical and at a 90 degree angle to said vertical leg extending horizontally towards said receptacle opening.

7. An information receptacle for receiving, holding and displaying relatively flat articles, which receptacle is fastened to a shelf according to claim 6, wherein said receptacle is constructed of a translucent material enabling an easy viewing of said articles and written shelving labels adhering to said shelf.

8. An information receptacle for receiving, holding and displaying relatively flat articles, which receptacle is fastened to a shelf according to claim 7, wherein a magnet is attached to and under surface of said hook-like end of said J-shaped plate such that said magnet is positioned horizontally to be in contact with a horizontal upper surface of said shelf preventing said receptacle from lateral movement.

9. An information receptacle for receiving, holding and displaying relatively flat articles, which receptacle is fastened to a shelf, comprising:

a holding means adjustably attached underneath said shelf for encasing, viewing and accessing said articles;

a forward attachment means for adjustably securing said receptacle to a front edge of said shelf consisting of a J-shaped plate having an elongated horizontal section for sliding into or out of a first channel mounted to an upper outside surface of said holding means and a hook-like end conforming to the shape of a front edge of said shelf;

a rearward attachment means for adjustably securing said receptacle to a rear edge of said shelf consisting of a U-shaped plate having an elongated horizontal section for sliding into or out of said first channel mounted to said upper outside surface of said holding means, wherein a U-shaped section is located at a rearward end of said U-shaped plate for clipping to a lip of said shelf at an underside section of said shelf.

10. An information receptacle for receiving, holding and displaying relatively flat articles, which receptacle is fastened to a shelf, comprising:

a holding means adjustably attached underneath said shelf for encasing, viewing and accessing said articles;

a forward attachment means for adjustably securing said receptacle to a front edge of said shelf consisting of a U-shaped plate having an elongated horizontal section for sliding into or out of a first channel mounted to an upper outside surface of said holding means, wherein a U-shaped section is located at a rearward end of said U-shaped plate for clipping to a lip of said shelf at an underside section of said shelf;

a rearward attachment means for adjustably securing said receptacle to a rear edge of said shelf consisting of a pair of slidably opposing mounting brackets for sliding into or out of a second channel mounted to an outside surface of a rearward end panel of said holding means, wherein each of said brackets consists of a horizontal leg for sliding into or out of said second channel, a vertical leg integral to said horizontal leg at an end of said horizontal leg forming a dog-leg configuration and a third leg functioning as a lip at an upper end of said vertical leg angled 90 degrees from said upper end extending horizontally towards said front open end of said holding means.

11. An information receptacle for holding and displaying relatively flat articles, which receptacle is fastened to a shelf, comprising:

a holding means adjustable attached underneath said shelf for encasing, viewing and accessing said articles;

a forward attachment means for adjustably securing said receptacle to a front edge of said shelf;

a rearward attachment means for adjustably securing said receptacle to a rear edge of said shelf;

wherein said forward attachment means and said rearward attachment means each consist of a U-shaped plate having an elongated horizontal section for sliding into or out of a first channel mounted to an upper outside surface of said holding means, wherein a U-shaped section is located at an end of said U-shaped plate for clipping to a lip of said shelf at an underside section of said shelf.

* * * * *